US006926119B1

(12) United States Patent
Schrock

(10) Patent No.: US 6,926,119 B1
(45) Date of Patent: Aug. 9, 2005

(54) FOLDING STEPS

(76) Inventor: Glenn Schrock, 915 Carver St., Traverse City, MI (US) 49686

( * ) Notice: Subject to any disclaimer, the term of this patent is extended or adjusted under 35 U.S.C. 154(b) by 0 days.

(21) Appl. No.: 10/681,463

(22) Filed: Oct. 9, 2003

(51) Int. Cl.[7] ..... G06C 1/00
(52) U.S. Cl. ..... 182/33; 182/152; 182/106
(58) Field of Search ..... 182/152, 33, 106; 297/44; D25/64

(56) References Cited

U.S. PATENT DOCUMENTS

| | | | | | |
|---|---|---|---|---|---|
| 540,794 | A | * | 6/1895 | Koch | 297/43 |
| 988,086 | A | | 3/1911 | Garraway | |
| 1,165,588 | A | | 12/1915 | Garraway | |
| D148,385 | S | | 1/1948 | Paulus | D15/8 |
| D157,436 | S | | 2/1950 | Rogers | D15/8 |
| 2,861,731 | A | * | 11/1958 | Robinson | 182/106 |
| 3,130,814 | A | | 4/1964 | Aquila | 182/106 |
| 3,142,351 | A | * | 7/1964 | Green | 180/8.2 |
| 3,142,355 | A | | 7/1964 | Danielson | 166/42 |
| 3,207,260 | A | | 9/1965 | Castagna | 182/106 |
| D214,264 | S | | 5/1969 | Holbrook | D25/99 |
| 4,711,282 | A | | 12/1987 | Frazier | 182/106 |
| 6,571,915 | B1 | | 6/2003 | de la Tour | 182/152 |

* cited by examiner

*Primary Examiner*—Alvin Chin-Shue
(74) *Attorney, Agent, or Firm*—Charles M. Kaplan

(57) ABSTRACT

A climbing aid for assisting people to move up or down to different levels has steps that can be folded into attached integral handrails that circumscribe the steps when folded so that no parts extend outside of the boundaries of the handrails.

22 Claims, 6 Drawing Sheets

FOLDING STEPS

BACKGROUND OF THE INVENTION

This invention relates to aiding people who have difficulty elevating themselves from one level to another, as for example stepping up into and down from a van, or climbing on to an examination table in a doctor's office or hospital. More particularly my invention relates to portable steps that have handrails and are easily stowable. The handrails on prior foldable steps did not provide adequate support for handicapped or elderly people. Also, when folded, the prior steps took up too much space or had projecting components or irregular outer surfaces that made it difficult to store the folded steps in a confined space.

OBJECTIVES OF THE INVENTION

Accordingly, it is an object of this invention to provide improved foldable steps with sturdy ergonomically designed handrails that inspire confidence in people that have difficulty stepping up or down.

Another object is to produce portable steps that fold inside of their integral handrails so as to provide a relatively smooth exterior surface that has no jagged edges or protruding parts so that the folded steps are stowable in relatively narrow confined spaces.

An additional object is to provide foldable steps having handrails that have flat outer surfaces when folded so that the folded steps will lie flat in an vehicle and can have other objects stored on top of them, and the flat outer surfaces of the folded steps also allow them to be easily stored against a flat wall surface or between the flat surfaces of furniture or cabinets.

Another object is to provide foldable steps that present a relatively continuous, firm, substantial supporting surface upon which relatively heavy objects can be safely stored when the steps are folded.

Another object is to provide foldable steps with relatively smooth outer surfaces that will not mar the surfaces of things that the folded steps are slid on or against or stored on, under or against.

A further object is to provide compact, portable, easily stored folding steps that have substantial handrails and are relatively light weight, durable, economical, attractive, easy to use and maintain, and which do not possess defects found in similar prior art folding steps.

Other objects and advantages of the folding steps incorporating my invention will be found in the specification and claims and the scope of the invention will be set forth in the claims.

DESCRIPTION OF THE INVENTION

Figure 3:
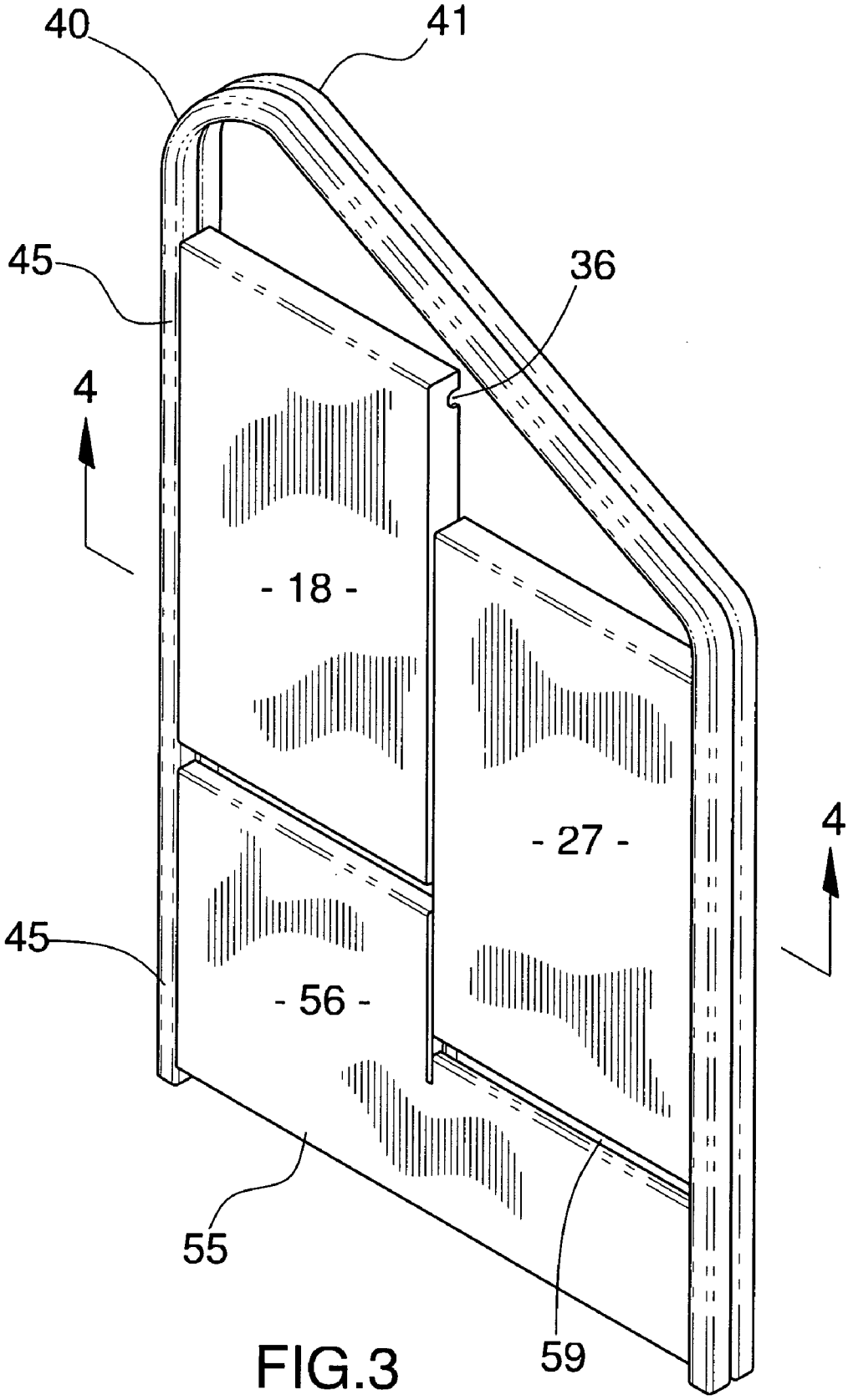
FIG. 3 is a perspective view of the foldable steps, showing the steps in their fully closed position.
Figure 4:
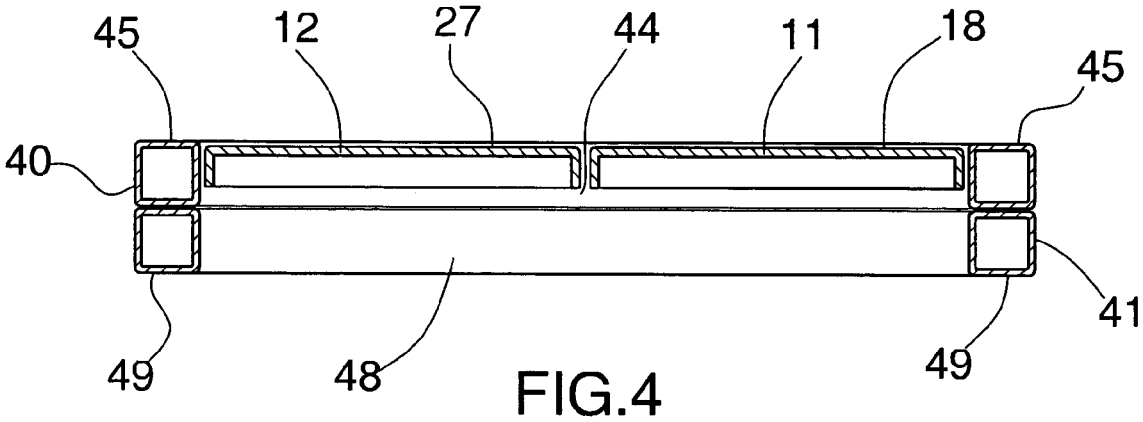
FIG. 4 is an enlarged, schematic, cross sectional view taken generally along the line 4—4 in FIG. 3.
Figure 5:
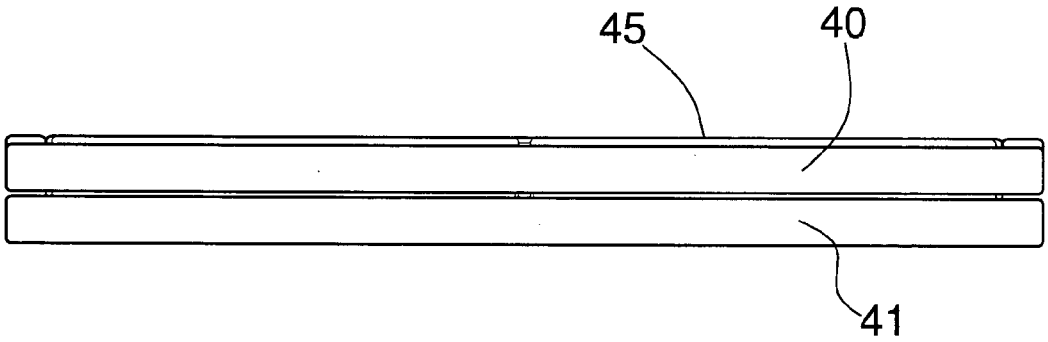
FIG. 5 is a top plan view of the steps in their fully closed position.

The drawing shows a compact, portable, folding climbing aid 10 in accord with my invention, that may be made from strong lightweight plastic or metal, such as aluminum or titanium. The aid 10 has a first fully open expanded position, as shown in FIGS. 1 and 6–8, and a second closed or folded position, as shown in FIGS. 3–5.

Figure 1:
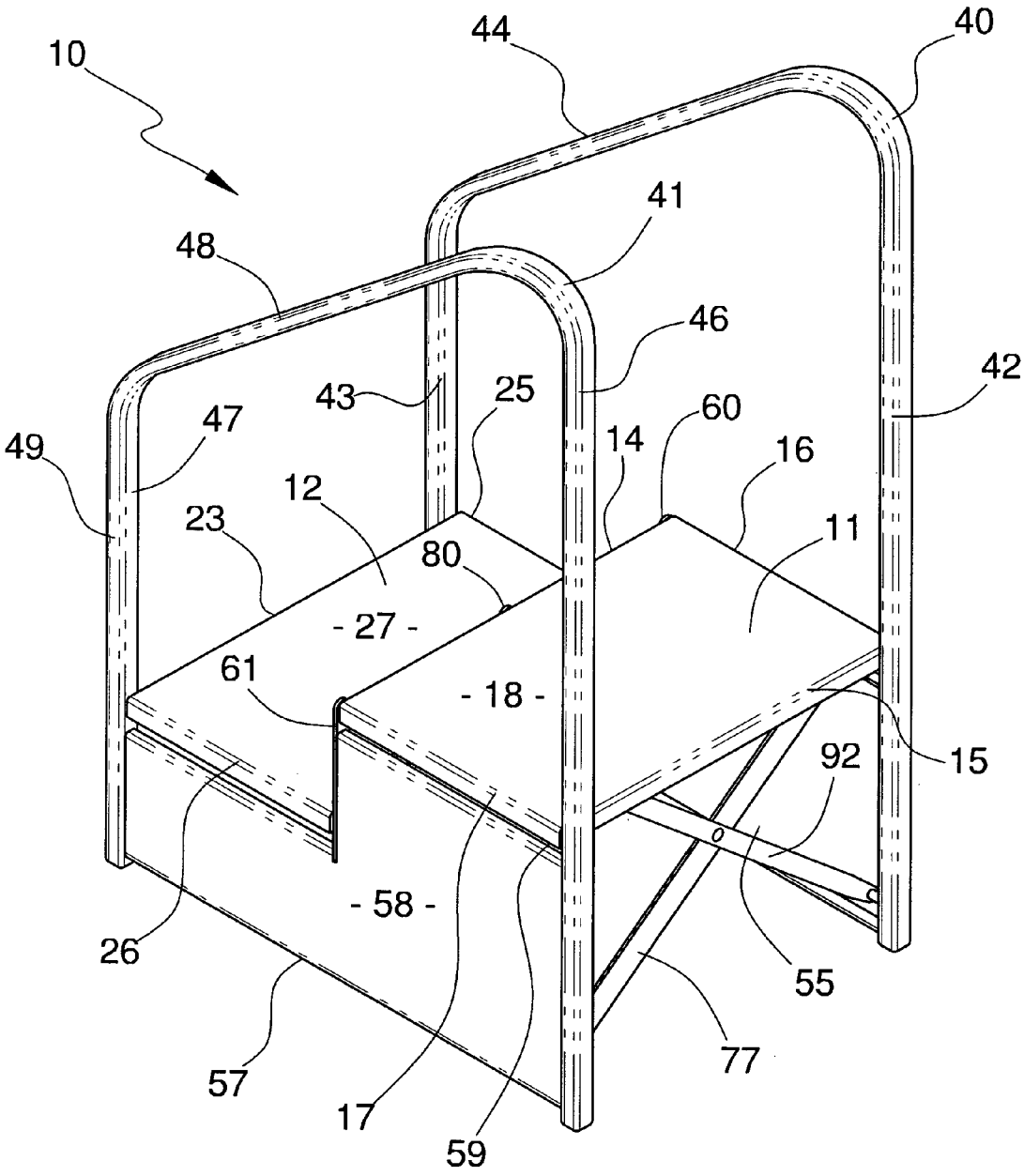
FIG. 1 is a perspective view of an embodiment of foldable steps in accord with this invention, showing the steps in their fully open position.
Figure 2:
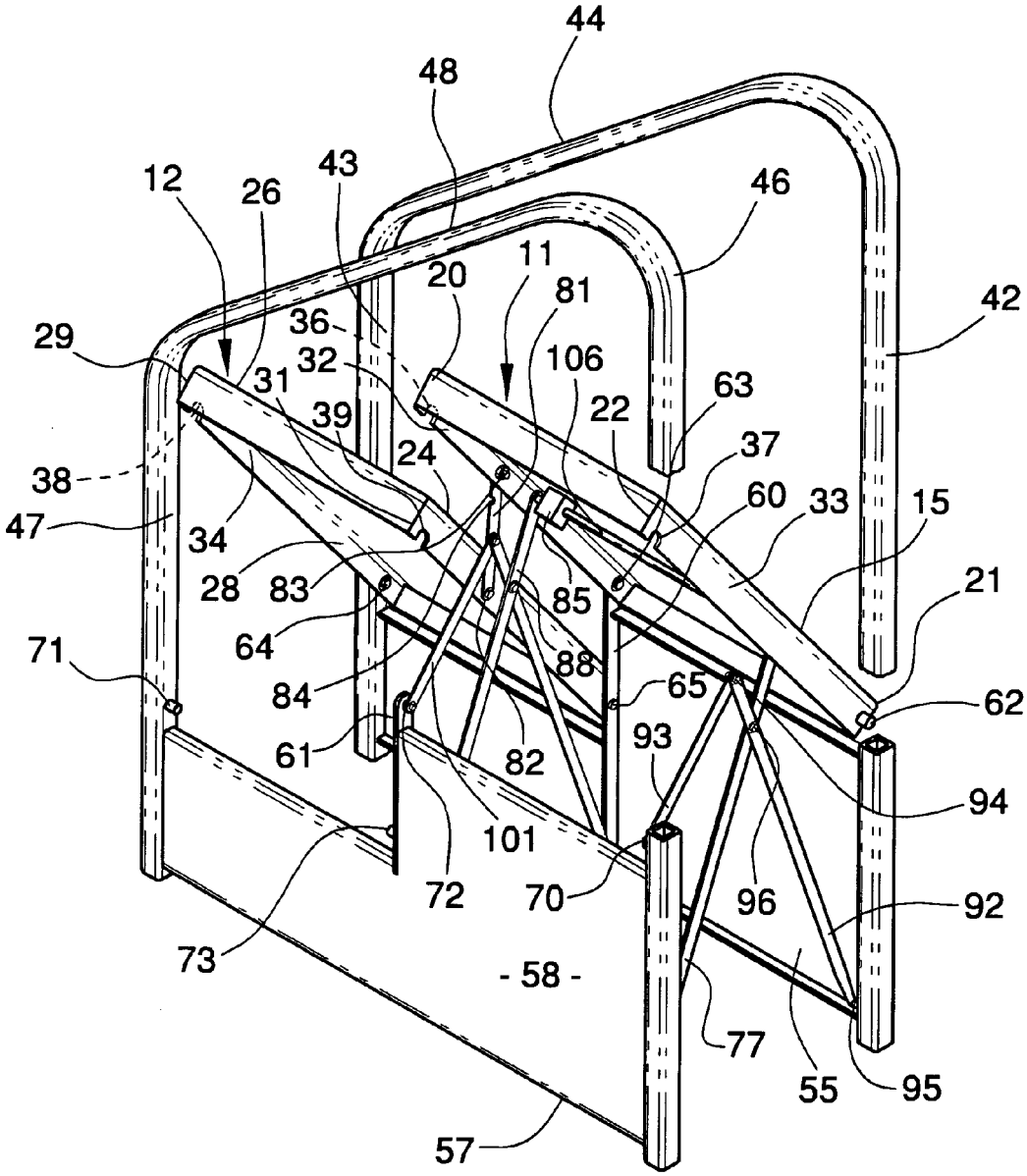
FIG. 2 is a perspective partially broken away view of the foldable steps, showing the steps in their partially open position.
Figure 6:
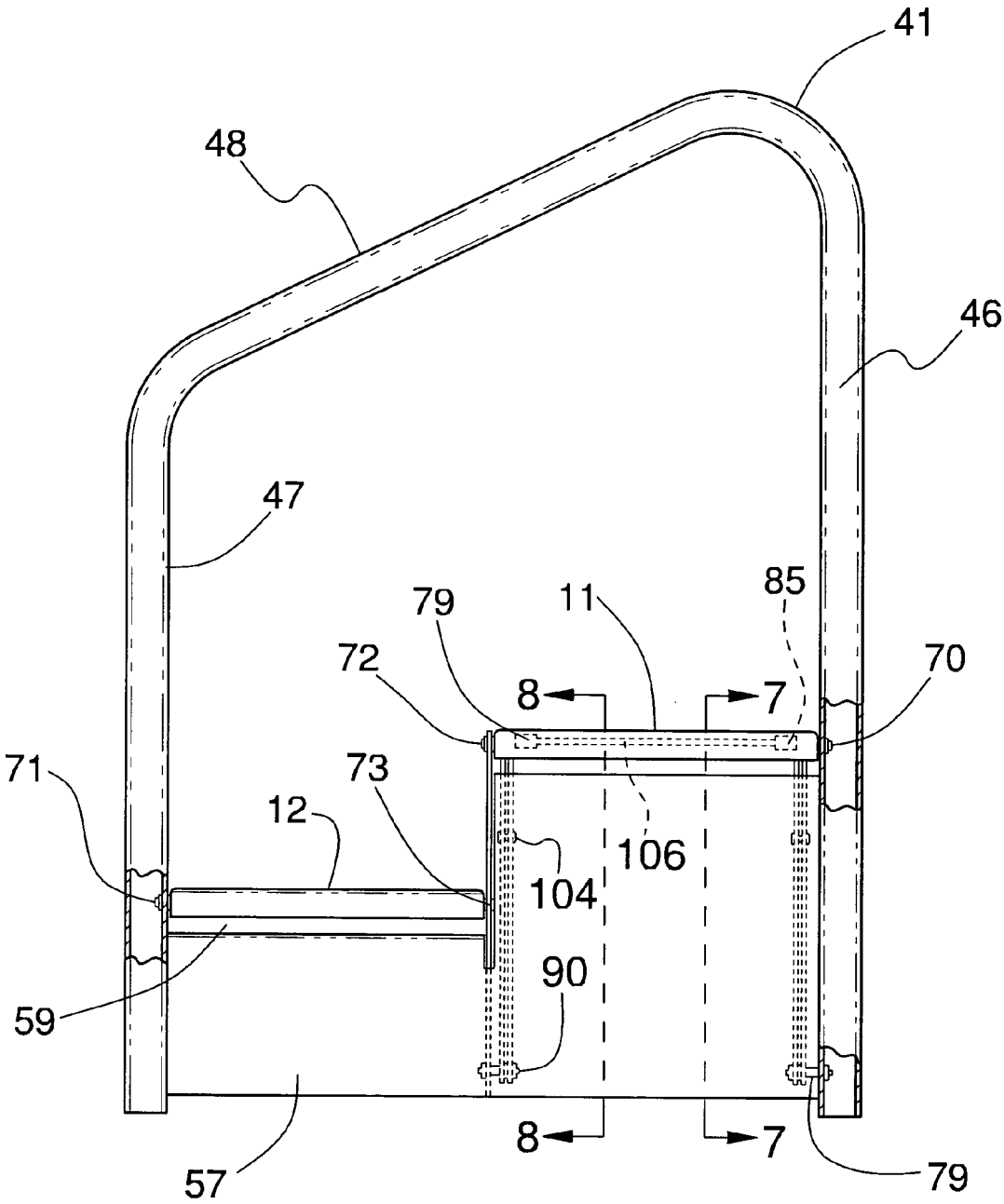
FIG. 6 is a partially broken away, schematic, side view showing the steps in their open position.
Figure 7:
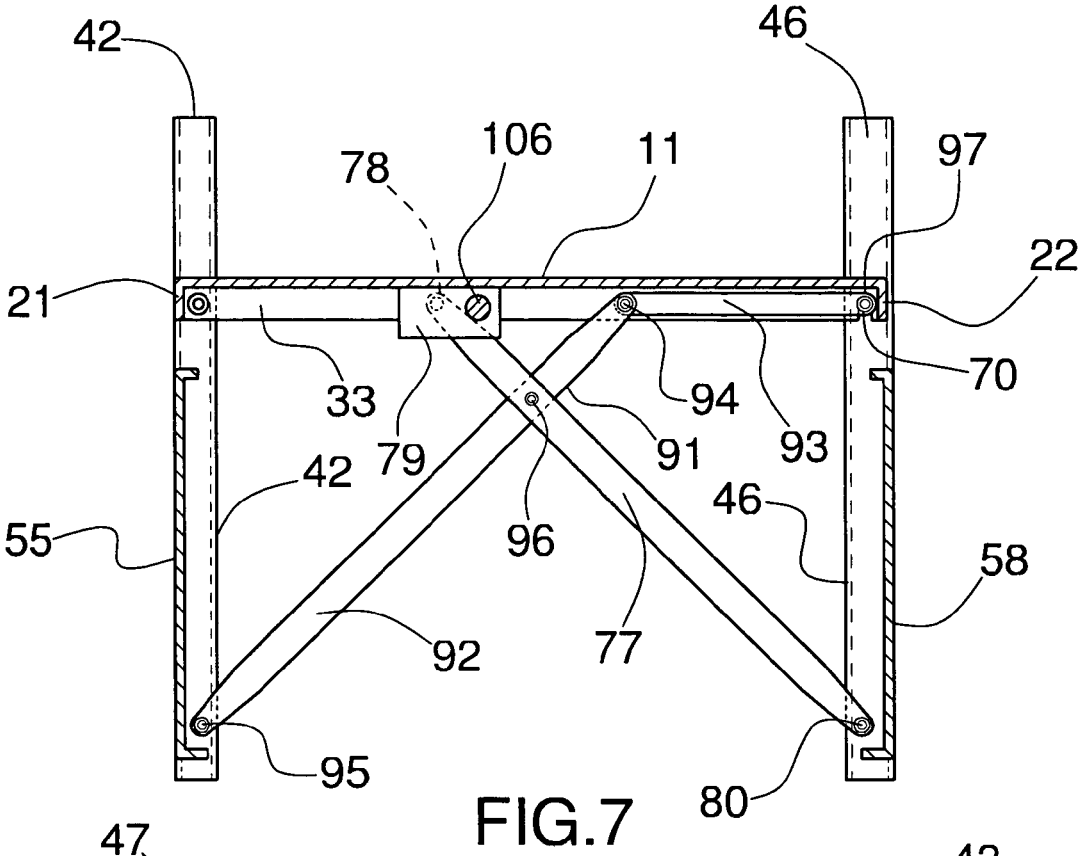
FIG. 7 is a cross sectional view taken along the line 7—7 in FIG. 6.
Figure 8:
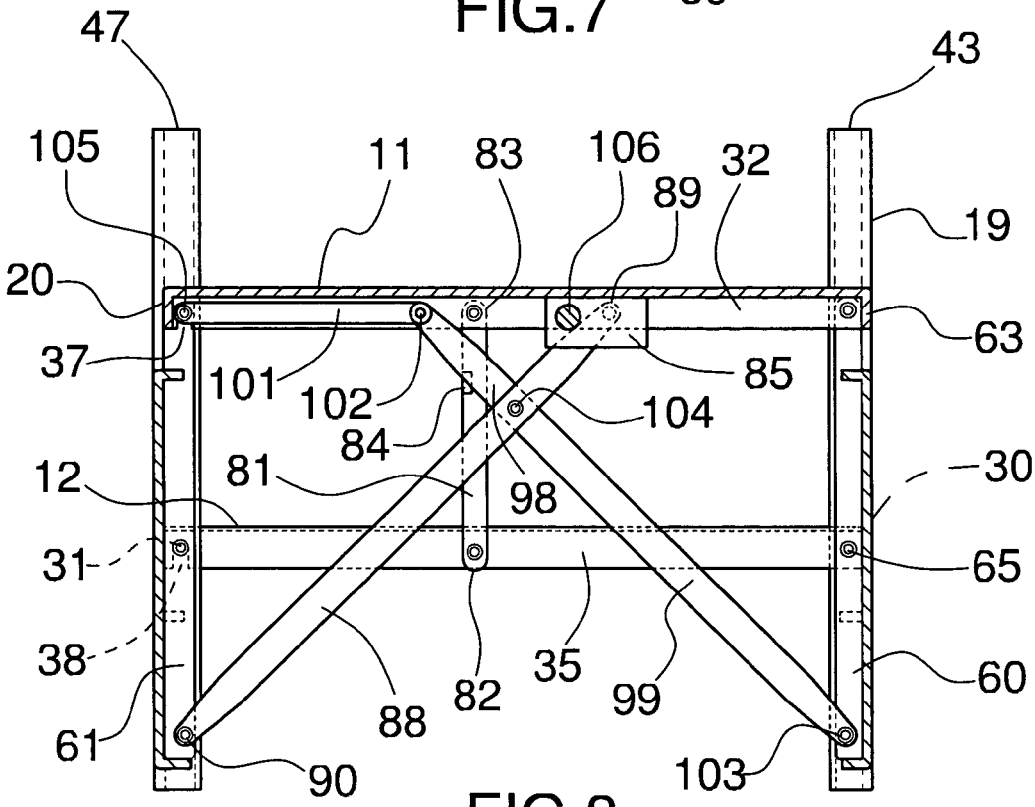
FIG. 8 is a cross sectional view taken along the line 8—8 in FIG. 6.

Aid 10 has a first upper step 11 that is located above a second lower step 12 when the aid 10 is in its open position. The step 11 has a front edge 14, a rear edge 15, one side edge 16, an opposite side edge 17, and a flat tread surface 18. As shown in FIGS. 2, 7 and 8, front edge 14 has an attached pivoting end 19 and an unattached free end 20, and rear edge 15 has an attached pivoting end 21 and an unattached free end 22. The step 12 has a front edge 23, a rear edge 24, one side edge 25, an opposite side edge 26, and a flat tread surface 27. As shown in FIGS. 2, 6 an 8, front edge 23 has an attached pivoting end 28 and an unattached free end 29, and rear edge 24 has an attached pivoting end 30 and an unattached free end 31. The front edge 14 of step 11 has an integral flange 32 and the rear edge 15 has an integral flange 33 extending therefrom. The front edge 23 of step 12 has an integral flange 34 and the rear edge 24 has an integral flange 35 extending therefrom. The side edges of the steps also may have integral flanges extending therefrom. The flanges 32, 33, 34, and 35 each have a notch, respectively 36, 37, 38 and 39, adjacent their free unattached end.

The aid 10 has a first handrail 40 and an essentially identical second hand rail 41. Handrail 40 has a first leg 42 of predetermined length, a second leg 43 of lesser length, an integral slanting hand grip bar 44 connecting its legs, and an outwardly facing generally flat exterior surface 45. Handrail 41 has a first leg 46 of predetermined length, a second leg 47 of lesser length, an integral slanting hand grip bar 48 connecting its legs, and an outwardly facing generally flat exterior surface 49. The handrails 40 and 41 are generally square in cross section with chamfered corners. When in the aid 10 is in its expanded position, the steps 11 and 12 are horizontal and the handrails 40 and 41 are separated at the opposed side edges 16 and 17 and 25 and 26, respectively, for easy gripping by a person stepping up or down on the steps.

A first flat panel beam 55 connects the legs 42 and 43 of handrail 40 and spans the distance separating these legs. Beam 55 has a flat, smooth, outwardly facing exterior surface 56 that is aligned in the same plane with the flat exterior surface 45 of handrail 40. A second flat panel beam 57 connects the legs 46 and 47 of handrail 41 and spans the distance separating these legs. Beam 57 has a flat, smooth, outwardly facing exterior surface 58 that is aligned in the same plane with the flat exterior surface 49 of handrail 41. A slight clearance space 59 separates the beams and steps.

A first integral post 60 is attached to first beam 55 and extends above beam 55. A second integral post 61 is attached to second beam 57 and extends above beam 57. The attached end 30 of the rear edge 15 of step 11 is pivotally connected at 62 to leg 42 above beam 55. The attached end 29 of the front edge 14 of step 11 is pivotally connected at 63 to post 60 above beam 55. The attached end 31 of the front edge 23 of step 27 is pivotally connected at 64 to the leg 43 of handrail 40. The attached end 31 of the rear edge 24 of step 12 is pivotally connected at 65 to post 60 intermediate the ends of post 60.

A first hollow cylindrical sleeve bushing 70 extends from an interior surface of the leg 46 toward the leg 47 above the beam 57. A second hollow cylindrical sleeve bushing 71 extends from an inner surface of the leg 47 toward the leg 46 below the step 18. A third hollow cylindrical sleeve bushing 72 extends from the second post 61 and is diametrically aligned with the bushing 70. A fourth hollow cylindrical sleeve bushing 73 extends from the second post 61 and is diametrically aligned with the bushing 71. The bushings 70 and 71 are secured in place by bolts that pass therethrough and are threaded into rivetnuts in the designated legs. The bushings 72 and 73 are held on the posts 60 and 61 by bolts that pass therethrough and are threaded into nuts. When the aid 10 is in its fully extended position, the unattached free end 22 of edge 15 of the step 18 is supported on the bushing 70 which is received in the notch 37, the unattached free end 20 of edge 14 of the step 18 is supported on the bushing 72 which is received in the notch 36, the unattached free end 31 of edge 24 of the step 27 is supported on the bushing 73 which is received in the notch 39, and the unattached free end 29 of edge 23 of the step 27 is supported on the bushing 71 which is received in the notch 38.

A first pivoting link 77 is pivotally connected at one end 78 to the outer side of a first rectangular prismatic support block 79 that is attached by bolts or welding (not shown) at a central location on the underside of step 11 adjacent to its rear edge 15. The opposite end 80 of link 77 is pivotally attached to leg 46 adjacent the terminal end of the leg. A second pivoting link 81 is pivotally attached at one end 82 to a central portion of the flange 35 at the rear edge 24 of step 12 and at its opposite end 83 to a central portion of the flange 32 at the front edge 14 of step 11. An integral tab 84 extends perpendicularly to link 81 toward step 11. When the aid 10 is in its fully closed position, the tab 84 will bind against the edge 14 and prevent the step 12 from moving out of alignment past the step 18.

A third pivoting link 88 is pivotally attached at one end 89 to the outer side of a second rectangular prismatic support block 85 that is attached by bolts or welding (not shown) at a central location on the underside of step 11 adjacent to its front edge 14. The opposite end 90 of link 88 is pivotally attached to the post 61 below the bushing 73. A first articulated pivoting link 91 has a long segment 92 and a short segment 93 that are pivotally connected to each other at one end at 94. The opposite end 95 of the long segment 92 is pivotally attached to the leg 42 adjacent its terminal end. The long segment 92 of the first articulated link 91 and the link 71 are pivotally connected to each other at 96 intermediate their ends. The opposite end 97 of the short segment 93 is pivotally connected to the bushing 70. A second pivoting articulated link 98 has a long segment 99 and a short segment 101 that are pivotally connected to each other at one end at 102. The opposite end 103 of the long segment 99 is pivotally attached adjacent the bottom end of the first post 60. The long segment 99 and the third link 88 are pivotally connected to each other at 104 intermediate their ends. The opposite end 105 of the short segment 101 is pivotally connected to the third bushing 72.

A cylindrical stabilizer bar 106 has its opposite ends attached to the inner side of block 79 and the inner side of block 85 below step 11. The effect of bar 106 is to interconnect the links 77, 81, 91 and 98. This enables the bar to stabilize the aid 10 by preventing misalignment or wobbling of the links or steps.

When the aid 10 is in its folded position, as shown in FIGS. 4 and 5, all of the pivoting links, the bushings and the steps and the beams are confined within the inner edges or boundaries of the handrails 40 and 41. There are no protruding bulges or sharp corners or edges that can mar other objects. The flat tread step surfaces 18 and 27, the flat exterior beam surfaces 56 and 58, and the flat exterior handrail surface 45 can all be aligned in the same plane. As shown in FIG. 3, these aligned planar surfaces occupy at least about 80% of the space circumscribed by the handrails. This relatively large, essentially continuous flat surface within the handrails enables the folded aid 10 to be easily slid on, against or between other flat or uneven surfaces for storing. This flat surface also is available as a firm horizontal supporting surface for holding or stacking heavy objects when the aid 10 is laid out horizontally.

While the present invention has been described with reference to particular embodiments, it is not intended to illustrate or describe all of the equivalent forms or ramifications thereof. Also, the words used are words of description rather than limitation, and various changes may be made without departing from the spirit or scope of the invention disclosed herein. It is intended that the appended claims cover all such changes as fall within the true spirit and scope of the invention.

What is claimed is:

1. A climbing aid for assisting a person to step up or down, comprising:

first and second steps, each of which has a front edge, a rear edge and opposite side edges, said front and rear edges each having an attached end and an unattached free end;

first and second handrails each of which has a pair of separated legs and an integral bar connecting upper ends of its separated legs;

said climbing aid having a first expanded position in which said steps are horizontal and said handrails are separated at said opposite side edges of said steps for gripping by a person stepping up or down on said steps, said first step being above said second step when said climbing aid is in its expanded position;

said climbing aid having a second folded position in which said handrails have been moved adjacent to each other for stowing said climbing aid;

the attached end of said rear edge of the first step being pivotally connected to one leg of said first handrail, a first link pivotally attached at one end adjacent to a central portion of said first step adjacent said rear edge, and said first link being pivotally connected at its opposite end to one of the legs of said second handrail;

a first bushing extending from said one leg of said second handrail toward the other leg of said second handrail, said unattached end of said rear edge of said first step being supported on said first bushing when said climbing aid is in its expanded position;

the attached end of said front edge of the second step being pivotally connected to the opposite leg of said first handrail, a second link pivotally attached at one end to a central portion of said rear edge of said second step, said second link being pivotally connected at its opposite end to said front edge of said first step;

a second bushing extending from said opposite leg of said second handrail toward said one leg of said second handrail, said unattached end of said front edge of said second step being supported on said second bushing when said climbing aid is in its expanded position; and said first and second steps and said said first and second links being folded into said first and second handrails when said climbing aid is in its folded position.

2. The climbing aid defined in claim 1, wherein said steps and links are confined within said handrails with no part of said steps and links extending beyond said handrails when said climbing aid is in its folded position.

3. The climbing aid defined in claim 1, further comprising: an integral tab on said second link that binds against said first step so as to prevent said second step from moving past said first step when said climbing aid is in its folded position.

4. The climbing aid defined in claim 1, further comprising: a first beam connecting the legs of said first handrail, a first post extending from said first beam, the attached end of said front edge of said first step being pivotally connected to said first post, the attached end of said rear edge of said second step being pivotally connected to said first post below said first step, a second beam connecting said legs of said second handrail, a second post extending from said second beam, a third bushing extending from said second post toward said one leg of said second handrail, said unattached end of said front edge of said first step being supported on said third bushing when said climbing aid is in its expanded position; a fourth bushing extending from said second post toward said other leg of said second handrail below said third bushing, said unattached end of said rear edge of said second step being supported on said fourth bushing below said first step when said climbing aid is in its expanded position.

5. The climbing aid defined in claim 4, further comprising: a first support block attached to the underside of said first step adjacent its rear edge, said one end of said first link being attached to said first support block, a second support block attached to the underside of said first step adjacent its front edge, a stabilizer bar connected at opposite ends to said first and second support blocks below said first step, a third link pivotally attached at one end to said second support block, and said third link being pivotally connected at its opposite end to said second post below said fourth bushing, a first articulated link having a long segment and a short segment that are pivotally connected to each other at one end, the opposite end of said long segment of said first articulated link being pivotally attached to said one leg of said first handrail adjacent its terminal end, said long segment of said first articulated link and said first link being pivotally connected to each other intermediate their ends, the opposite end of said short segment of said first articulated link being connected to said first bushing, a second articulated link having a long segment and a short segment that are pivotally connected to each other at one end, the opposite end of said long segment of said second articulated link being pivotally attached to said first post below said third bushing, said long segment of said second articulated link and said third link being pivotally connected to each other intermediate their ends, and the opposite end of said short segment of said second articulated link being connected to said third bushing.

6. The climbing aid defined in claim 4, further comprising: the front and rear edges of said first step comprising integral flanges projecting therefrom, there being a notch in each flange adjacent said unattached end of said first step, said notches in said first step engaging said first and third bushings when said climbing aid is in its expanded position, and the front and rear edges of said second step comprising integral flanges projecting therefrom, there being a notch in each flange adjacent said unattached end of said second step, and said notches in said second step engaging said second and fourth bushings when said climbing aid is in its expanded position.

7. The climbing aid defined in claim 4, wherein said first beam comprises a flat panel spanning the distance separating said legs of said first handrail, said flat panel has an outwardly facing surface that is aligned with an outwardly facing surface of said first handrail, said steps have flat tread surfaces that are aligned with said outwardly facing surface of flat panel so as to form with said outwardly facing surface of said flat panel and said outwardly facing surface of said first handrail an essentially continuous flat surface that fills a substantial portion of the space between the legs and bar of said first handrail when said climbing aid is in said folded position.

8. A portable climbing aid for assisting a person to step up or down, comprising:

first and second steps, each of which has a front edge, a rear edge and opposite side edges, said front and rear edges each having an attached end and an unattached free end;

first and second essentially identical handrails each of which has a first leg of predetermined length and an essentially parallel second leg of lesser length, and an integral slanting bar connecting upper ends of said first and second legs;

said portable climbing aid having a first expanded position in which said steps are horizontal and said handrails are separated at said opposed side edges of said steps for gripping by a person stepping up or down on said steps;

said portable climbing aid having a second folded position in which said handrails have been moved adjacent to each other for stowing said portable climbing aid;

the attached end of said front edge of the first step being pivotally connected to the first leg of said first handrail, a first link pivotally attached at one end to a central portion of said first step adjacent said rear edge, and said first link being pivotally connected at its opposite end to the first leg of said second handrail;

a first bushing extending from said first leg of said second handrail toward said second leg of said second handrail, said unattached end of said rear edge of said first step being supported on said first bushing when said portable climbing aid is in its first expanded position;

the attached end of said rear edge of the second step being pivotally connected to the second leg of said first handrail, a second link pivotally attached at one end to a central portion of said rear edge of said second step, said second link being pivotally connected at its opposite end to said front edge of said first step;

a second bushing extending from said second leg of said second handrail toward said first leg of said second handrail, said unattached end of said front edge of said second step being supported on said second bushing when said portable climbing aid is in its first expanded position; and said first and second steps and said first and second links being enclosed within said first and second handrails when said portable climbing aid is in its second folded position.

9. The portable climbing aid defined in claim 8, further comprising: a first beam connecting said first and second legs of said first handrail, a first post extending from said first beam, the attached end of said front edge of said first step being pivotally connected to said first post, the attached end of said rear edge of said second step being pivotally connected to said first post below said first step, a second beam connecting said first and second legs of said second handrail, a second post extending from said second beam, a third bushing extending from said second post toward said first leg of said second handrail, said unattached end of said front edge of said first step being supported on said third bushing when said portable climbing aid is in its first expanded position; a fourth bushing extending from said second post toward said second leg of said second handrail below said third bushing, said unattached end of said rear edge of said second step being supported on said fourth bushing below said first step when said portable climbing aid is in its first expanded position.

10. The portable climbing aid defined in claim 9, further comprising: a first support block attached to the underside of said first step adjacent its rear edge, said one end of said first link being attached to said first support block, a second support block attached to the underside of said first step adjacent its front edge, a stabilizer bar connected at opposite ends to said first and second support blocks below aid first step, a third link pivotally attached at one end to said second support block, and said third link being pivotally connected at its opposite end to said second post below said fourth bushing, a first articulated link having a long segment and a short segment that are pivotally connected to each other at one end, the opposite end of said long segment of said first articulated link being pivotally attached to said first leg of said first handrail adjacent its terminal end, said long segment of said first articulated link and said first link being pivotally connected to each other intermediate their ends, the opposite end of said short segment of said first articulated link being connected to said first bushing, a second articulated link having a long segment and a short segment that are pivotally connected to each other at one end, the opposite end of said long segment of said second articulated link being pivotally attached to said first post below said third bushing, said long segment of said second articulated link and said third link being pivotally connected to each other intermediate their ends, and the opposite end of said short segment of said second articulated link being connected to said third bushing.

11. The portable climbing aid defined in claim 9, further comprising: the front and rear edges of said first step comprising integral flanges projecting therefrom, there being a notch in each flange adjacent said unattached end of said first step, said notches in said first step engaging said first and third bushings when said portable climbing aid is in its expanded position, and the front and rear edges of said second step comprising integral flanges projecting therefrom, there being a notch in each flange adjacent said unattached end of said second step, and said notches in said second step engaging said second and fourth bushings when said portable climbing aid is in its expanded position.

12. The portable climbing aid defined in claim 9, wherein said first and second legs of said handrails are generally parallel and said first beam comprises a flat panel spanning the distance separating said legs of said first handrail, said flat panel has an outwardly facing surface that is aligned with an outwardly facing surface of said first handrail, said steps have flat tread surfaces that are aligned with said outwardly facing surface of said flat panel so as to form with said outwardly facing surface of said flat panel and said outwardly facing surface of said first handrail an essentially continuous flat surface that fills a substantial portion of the space between the legs and bar of said first handrail when said climbing aid is in said folded position.

13. The portable climbing aid defined in claim 8, further comprising: an integral tab perpendicularly toward said first step in the direction of the first legs of said handrails for binding against said first step so as to prevent said second step from moving past said first step when said portable climbing aid is in its second folded position.

14. A compact, portable climbing aid, comprising:

a pair of steps each of which has a front edge, a rear edge and opposite side edges, first and second essentially identical handrails each of which has a pair of parallel legs that are connected by an integral bar, each of said handrails having an inwardly facing surface and an opposite outwardly facing surface;

each of said steps being pivotally attached at one of its edges to one of said legs of said handrails, an edge on each of said steps that is opposite to said one edge being unattached to said legs, and pivoting links connecting said steps to said legs intermediate the opposite edges of the steps;

said portable climbing aid having a first expanded position in which said steps are horizontal and said handrails are separated at said opposite side edges of said steps for gripping by a person stepping up or down on said steps;

bushings on said legs supporting the unattached edges of said steps when said portable climbing aid is in its expanded position;

said portable climbing aid having a second folded position in which said handrails have been moved toward each other for stowing said portable climbing aid, said inwardly facing surfaces of said handrails being in contact with each other when said portable climbing aid is in said second folded position, and said steps and said links being confined within said legs and bars of said handrails with no part of said steps and links extending past the outwardly facing surfaces of said handrails when said portable climbing aid is in said folded position.

15. A compact, portable climbing aid, comprising:

a pair of steps each of which has a front edge, a rear edge and opposite side edges, first and second essentially identical handrails each of which has a pair of parallel legs that are connected by an integral bar, each of said handrails having an inwardly facing surface and an opposite outwardly facing surface;

each of said steps being pivotally attached at one of its edges to one of said legs of said handrails, and pivoting links connecting said steps to said legs intermediate the opposite edges of the steps;

said portable climbing aid having a first expanded position in which said steps are horizontal and said handrails are separated at said opposite side edges of said steps for gripping by a person stepping up or down on said steps;

said portable climbing aid having a second folded position in which said handrails have been moved toward each other for stowing said portable climbing aid, said inwardly facing surfaces of said handrails being in contact with each other when said portable climbing aid is in said second folded position, and said steps and said links being confined within said legs and bars of said handrails with no part of said steps and links extending past the outwardly facing surfaces of said handrails when said portable climbing aid is in said folded position; a beam connecting the legs of one of said handrails, said beam comprising a flat panel spanning the distance separating the legs of said one handrail, said flat panel having an outwardly facing surface that is aligned with the outwardly facing surface of said one handrail, said flat tread surfaces of said steps being aligned with said outwardly facing surface of flat panel so as to form with said outwardly facing surface of said flat panel and said outwardly facing surface of said legs an essentially continuous flat surface that fills a substantial portion of the space between the legs and bar of said one handrail when said portable climbing aid is in said folded position.

16. A compact, portable climbing aid, comprising:

a pair of steps each of which has a front edge, a rear edge and opposite side edges, first and second essentially identical handrails each of which has a pair of parallel legs that are connected by an integral bar, each of said handrails having an inwardly facing surface and an opposite outwardly facing surface;

each of said steps being pivotally attached at one of its edges to one of said legs of said handrails, and pivoting links connecting said steps to said legs intermediate the opposite edges of the steps;

said portable climbing aid having a first expanded position in which said steps are horizontal and said handrails are separated at said opposite side edges of said steps for gripping by a person stepping up or down on said steps;

said portable climbing aid having a second folded position in which said handrails have been moved toward each other for stowing said portable climbing aid, said inwardly facing surfaces of said handrails being in substantial contact with each other when said portable climbing aid is in said second folded position, and said steps and said links being confined within said legs and bars of said handrails with no part of said steps and links extending past the outwardly facing surfaces of said handrails when said portable climbing aid is in said folded position; one of said steps being above the other of said steps when said climbing aid is in its expanded position, the attached end of said rear edge of said one step being pivotally connected to a first leg of said first handrail, a first link pivotally attached at one end to a central portion of said one step adjacent said rear edge, and said first link being pivotally connected at its opposite end to a first leg of said second handrail;

a first bushing extending from said first leg of said second handrail toward a second leg of said second handrail, an unattached end of said rear edge of said one step being supported on said first bushing when said portable climbing aid is in its expanded position;

the attached end of said front edge of said other step being pivotally connected to a second leg of said first handrail, a second link pivotally attached at one end to a central portion of said rear edge of said other step, said second link being pivotally connected at its opposite end to said front edge of said one step;

a second bushing extending from said second leg of said second handrail toward said first leg of said second handrail, an unattached end of said front edge of said other step being supported on said second bushing when said portable climbing aid is in its expanded position; an integral tab extending generally perpendicularly toward said one step in the direction of said first legs of said handrails for binding against said one step so as to prevent said second step from moving past said one step when said climbing aid is in its folded position.

17. The compact, portable climbing aid defined in claim 16, further comprising: a first beam connecting said first and second legs of said first handrail, a first post extending from said first beam, the attached end of said front edge of said one step being pivotally connected to said first post, the attached end of said rear edge of said second step being pivotally connected to said first post below said one step, a second beam connecting said first and second legs of said second handrail, a second post extending from said second beam, a third bushing extending from said second post toward said first leg of said second handrail, said unattached end of said front edge of said one step being supported on said third bushing when said portable climbing aid is in its expanded position; a fourth bushing extending from said second post toward said second leg of said second handrail below said third bushing, said unattached end of said rear edge of said other step being supported on said fourth bushing below said one step when said portable climbing aid is in its expanded position.

18. The portable climbing aid defined in claim 17, further comprising: a first support block attached to the underside of said first step adjacent its rear edge, said one end of said first link being attached to said first support block, a second support block attached to the underside of said first step adjacent its front edge, a stabilizer bar connected at opposite ends to said first and second support blocks below aid first step, a third link pivotally attached at one end to said second support block, and said third link being pivotally connected at its opposite end to said second post below said fourth bushing, a first articulated link having a long segment and a short segment that are pivotally connected to each other at one end, the opposite end of said long segment of said first articulated link being pivotally attached to said first leg of said first handrail adjacent its terminal end, said long segment of said first articulated link and said first link being pivotally connected to each other intermediate their ends, the opposite end of said short segment of said first articulated link being connected to said first bushing, a second articulated link having a long segment and a short segment that are pivotally connected to each other at one end, the opposite end of said long segment of said second articulated link being pivotally attached to said first post below said third bushing, said long segment of said second articulated link and said third link being pivotally connected to each other intermediate their ends, and the opposite end of said short segment of said second articulated link being connected to said third bushing.

19. The portable climbing aid defined in claim 17, further comprising: the front and rear edges of said one step comprising integral flanges projecting therefrom, there being a notch in each flange adjacent said unattached end of said one step, said notches in said one step engaging said first and third bushings when said portable climbing aid is in its expanded position, and the front and rear edges of said other step comprising integral flanges projecting therefrom, there being a notch in each flange adjacent said unattached end of said other step, and said notches in said other step engaging said second and fourth bushings when said portable climbing aid is in its expanded position.

20. A portable climbing aid for assisting a person to step up or down, comprising:

a step having a front edge, a rear edge and opposite side edges, said front and rear edges each having an attached end and an unattached free end;

first and second handrails each of which has a pair of separated legs and an integral bar connecting upper ends of its separated legs;

said portable climbing aid having a first expanded position in which said step is horizontal and said handrails are separated at said opposite side edges of said step for gripping by a person stepping up or down on said step;

said portable climbing aid having a second folded position in which said handrails have been moved adjacent to each other for stowing said portable climbing aid;

the attached end of said rear edge of said step being pivotally connected to one leg of said first handrail, a first link pivotally attached at one end adjacent to a central portion of said step adjacent said rear edge, and said first link being pivotally connected at its opposite end to one of the legs of said second handrail;

one bushing extending from said one leg of said second handrail toward the other leg of said second handrail, said unattached end of said rear edge of said step being supported on said one bushing when said portable climbing aid is in its expanded position;

a first beam connecting the legs of said first handrail, a first post extending from said first beam, the attached end of said front edge of said step being pivotally connected to said first post, a second beam connecting said legs of said second handrail, a second post extending from said second beam, an other bushing extending from said second post toward said one leg of said second handrail, said unattached end of said front edge of said step being supported on said other bushing when said portable climbing aid is in its expanded position;

a first articulated link having a long segment and a short segment that are pivotally connected to each other at one end, the opposite end of said long segment of said first articulated link being pivotally attached to said one leg of said first handrail adjacent its terminal end, said long segment of said first articulated link and said first link being pivotally connected to each other intermediate their ends, the opposite end of said short segment of said first articulated link being connected to said one bushing, a second articulated link having a long segment and a short segment that are pivotally connected to each other at one end, the opposite end of said long segment of said second articulated link being pivotally attached to said first post below said third other bushing, said long segment of said second articulated link and said third an other link being pivotally connected to each other intermediate their ends, and the opposite end of said short segment of said second articulated link being connected to said third other bushing.

21. The portable climbing aid defined in claim 20, further comprising: a first support block attached to the underside of said step adjacent its rear edge, said one end of said first link being attached to said first support block, a second support block attached to the underside of said step adjacent its front edge, a stabilizer bar connected at opposite ends to said first and second support blocks below said step, said other link pivotally attached at one end to said second support block, and said other link being pivotally connected at its opposite end to said second post.

22. The portable climbing aid defined in claim 20, further comprising: said front and rear edges of said step comprising integral flanges projecting generally perpendicularly therefrom, there being a notch in each flange adjacent said unattached free end of said step, said notches in said step engaging said one bushing and said other bushing when said portable climbing aid is in its expanded position.

* * * * *